US011151830B2

(12) United States Patent
Tang et al.

(10) Patent No.: US 11,151,830 B2
(45) Date of Patent: Oct. 19, 2021

(54) BANKNOTE TEMPORARY STORAGE MECHANISM AND BANKNOTE PROCESSING DEVICE

(71) Applicant: Shandong New Beiyang Information Technology Co., Ltd., Shandong (CN)

(72) Inventors: Xiaojie Tang, Shandong (CN); Xin Wang, Shandong (CN); Tao Gao, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 331 days.

(21) Appl. No.: 16/485,752

(22) PCT Filed: Feb. 7, 2018

(86) PCT No.: PCT/CN2018/075567

§ 371 (c)(1),
(2) Date: Aug. 13, 2019

(87) PCT Pub. No.: WO2018/149344

PCT Pub. Date: Aug. 23, 2018

(65) Prior Publication Data

US 2020/0058184 A1 Feb. 20, 2020

(30) Foreign Application Priority Data

Feb. 14, 2017 (CN) ..... 201710078342.9

(51) Int. Cl.
*G07D 11/00* (2019.01)

(52) U.S. Cl.
CPC ..... *G07D 11/009* (2013.01)

(58) Field of Classification Search
CPC ..... G07D 11/009; G07D 11/10; G07D 11/16
See application file for complete search history.

(56) References Cited

U.S. PATENT DOCUMENTS 5,975,273 A 11/1999 Zwahlen et al.
2004/0108328 A1* 6/2004 Youn ..... G06Q 20/1085 221/195
2008/0061497 A1* 3/2008 Ishikawa ..... B65H 31/24 271/207

FOREIGN PATENT DOCUMENTS

CN 101177214 A 5/2008
CN 101266702 A 9/2008
(Continued)

OTHER PUBLICATIONS

International Search Report dated May 8, 2018, in the International Application No. PCT/CN2018/075567, 4 pages.

*Primary Examiner* — Laura A Gudorf
(74) *Attorney, Agent, or Firm* — Wilmer Cutler Pickering Hale and Dorr LLP

(57) ABSTRACT

Provided are a banknote temporary storage mechanism (400) and a banknote processing device. The banknote temporary storage mechanism (400) is configured to enable the banknote to smoothly fall without getting jammed. The banknote temporary storage mechanism (400) includes a frame (8), a first door (1) pivotally connected to the frame (8), and a banknote pushing mechanism (4). The first door (1) has an open position and a closed position. The banknote pushing mechanism (4) includes a banknote pushing member (44). The banknote pushing member (44) is movably connected to the first door (1), and protrudes from a banknote support surface of the first door (1). The banknote pushing member (44) is configured to, as the first door (1) rotates towards the open position from the closed position, to move relative to the first door (1) along a direction in which a banknote is disengaged from the first door (1), to push the banknote to be disengaged from the first door (1).

20 Claims, 4 Drawing Sheets

(56) References Cited

FOREIGN PATENT DOCUMENTS

| | | | | |
|---|---|---|---|---|
| CN | 101425200 | A | | 5/2009 |
| CN | 101452591 | A | | 6/2009 |
| CN | 104008598 | A | | 8/2014 |
| CN | 105809816 | A | | 7/2016 |
| CN | 205375657 | U | | 7/2016 |
| CN | 205507966 | U | | 8/2016 |
| KR | 2002075552 | A | * | 10/2002 |

* cited by examiner

BANKNOTE TEMPORARY STORAGE MECHANISM AND BANKNOTE PROCESSING DEVICE

CROSS-REFERENCE TO RELATED APPLICATIONS

This application is a U.S. National Phase Application of International Patent Application number PCT/CN2018/075567 filed on Feb. 7, 2018, which claims the priority of China Patent Application No. 201710078342.9 titled "Banknote Temporary Storage Mechanism and Banknote Processing Device" and filed Feb. 14, 2017 before the State Intellectual Property Office of People's Republic of China, disclosures of both of which are incorporated herein by reference in their entireties.

TECHNICAL FIELD

The present disclosure relates to the technical field of financial equipment, for example, a banknote temporary storage mechanism and a banknote processing device.

BACKGROUND

Banknote processing devices include a sorting machine, a banknote counting machine, an automatic teller machine and so on. Banknote processing devices are configured to perform the following processing on a banknote, including authenticating, counting, sorting, depositing, withdrawing and the like. A banknote processing device is typically provided with a banknote temporary storage mechanism that is used to temporarily store a banknote that has been authenticated for other processing as desired.

FIG. 1 shows a banknote processing device in the related art that includes a banknote temporary storage mechanism and a cash box. The banknote temporary storage mechanism includes a first door 21' and a second door 22' that are oppositely arranged and operative to be opened from each other, and a driving mechanism 3' configured to drive the first door 21' and the second door 22' to rotate. The first door 21' and the second door 22' are each pivotally connected to a frame (not shown in the drawing) through a shaft, and can both be at an open position or a closed position at the same time driven by the driving mechanism 3'. When the first door 21' and the second door 22' are both at the closed position, the first door 21' and the second door 22' are connected at an angle, thereby closing an inlet of the cash box 1' disposed below. At this point, one end of the banknote 4' received by the banknote temporary storage mechanism abuts against the first door 21', and the banknote 4' is stacked on the second door 22'. When the first door 21' and the second door 22' are both at the open position to open the inlet of the cash box, the banknote 4' on the first door 21' and the second door 22' would fall into the cash box 1'.

Such banknote temporary storage mechanism has the following problem. When the two blocking doors are opened for the banknote to fall, factors such as a friction, an electrostatic adhesive force or the like that occurs between the banknote and the blocking doors may cause the banknote to drape on a lower edge of the blocking doors and so fail to fall down, causing the banknote to get jammed.

SUMMARY

Provided is a banknote temporary storage mechanism whereby a banknote falls smoothly avoiding the banknote from getting jammed.

Provided is a banknote temporary storage mechanism which includes a frame, a first door pivotally connected to the frame, and a banknote pushing mechanism.

The first door has an open position and a closed position.

The banknote pushing mechanism includes a banknote pushing member. The banknote pushing member is movably connected to the first door, and protrudes from a banknote support surface of the first door.

As the first door rotates towards the open position from the closed position, the banknote pushing member is configured to move relative to the first door along a direction in which a banknote is disengaged from the first door, to push the banknote to be disengaged from the first door.

Optionally, the banknote temporary storage mechanism further includes a banknote-push driving member, and a transmission assembly connected between the banknote-push driving member and the banknote pushing member.

The banknote-push driving member is configured to drive the transmission assembly to drive the banknote pushing member to move relative to the first door.

Optionally, the transmission assembly includes a first pulley and a second pulley that are arranged along the direction in which the banknote is disengaged from the first door and that are spaced apart from each other, the transmission assembly further including a transmission belt connected between the first pulley and the second pulley.

The banknote pushing member is connected to the transmission belt, and the banknote-push driving member is in a transmission connection with the first pulley.

Optionally, the banknote-push driving member is in a transmission connection with the first door.

The first door is configured to, as the first door rotates between the open position and the closed position, drive the banknote-push driving member to move, to make the banknote-push driving member drive the transmission assembly to drive the banknote pushing member to move relative to the first door.

Optionally, the banknote-push driving member comprises a guiding gear fixedly connected to the frame, and a transmission gear pivotally connected to the first door.

A central axis of the guiding gear coincides with a rotating axis of the first door.

The guiding gear is meshed with the transmission gear.

The transmission gear is in a transmission connection with the transmission assembly.

Optionally, the guiding gear is a sector gear.

Optionally, the banknote pushing member has an initial position and an end position.

When the banknote pushing member is at the initial position, a distance between the banknote pushing member and a side edge of the banknote support surface away from a rotating axis of the first door corresponds to a total thickness of a maximum number of banknotes the first door receives at one time.

The banknote pushing member is configured to push the banknote to be disengaged from the banknote support surface when the banknote pushing member is at the end position.

Optionally, the banknote pushing member has a banknote pushing surface arranged perpendicular to the banknote support surface.

Optionally, the first door is provided with a guiding groove extending along the direction in which the banknote is disengaged from the first door. The banknote pushing member is embedded in the guiding groove and is configured to move along a length of the guiding groove.

Optionally, the banknote temporary storage mechanism further includes a second door pivotally connected to the frame. The second door has an open position and a closed position.

When the first door and the second door are both in the closed position, the first door and the second door are connected to each other at an angle to form a banknote stacking space.

When the first door and the second door are both in the open position, the first door and the second door are separated from each other.

The first door of the banknote temporary storage mechanism provided by the present disclosure is pivotally connected to the frame. The first door has an open position and a closed position. The banknote pushing mechanism of the banknote temporary storage mechanism includes a banknote pushing member movably connected to the first door. The banknote pushing member protrudes from the banknote support surface of the first door. The banknote pushing member is configured to, as the first door rotates towards the open position from the closed position, move relative to the first door along the direction in which the banknote is disengaged from the first door, to push the banknote to be disengaged from the first door.

There is further provided a banknote processing device that includes a banknote temporary storage mechanism as described above.

Compared with the banknote temporary storage mechanism and the banknote processing device in the related art, the banknote temporary storage mechanism and the banknote processing device provided by the present disclosure drive the banknote that falls to move through the banknote pushing member, which increases the driving force for disengaging the banknote from the first door. Thus, the banknote can be prevented from getting jammed, and the banknote can be smoothly disengaged from the first door until the banknote falls into the cash box disposed under the banknote temporary storage mechanism.

Figure 1:
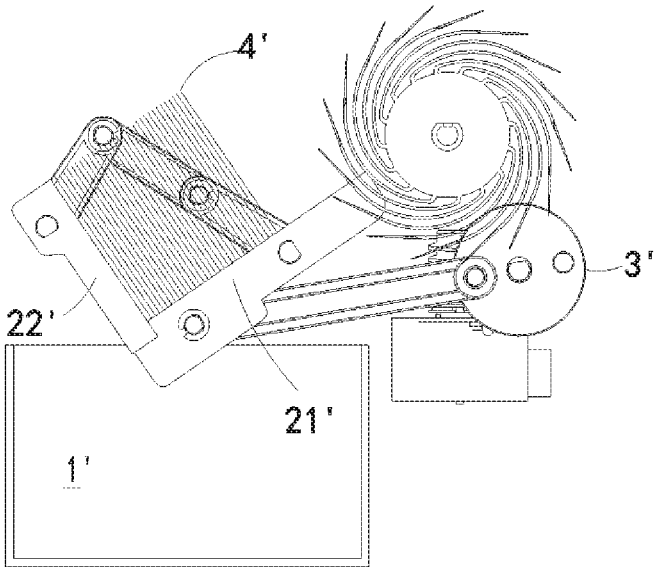
FIG. 1 is a structural schematic view of a banknote temporary storage mechanism in the related art.

In the drawings: 1-First door; 2-Second door; 4-Banknote pushing mechanism; 8-Frame; 10-First shaft; 11-First supporting plate; 12-Side wall; 20-Second shaft; 21-Second supporting plate; 31-Motor; 32-Worm; 33-Worm gear; 34-Driving shaft; 35-Cam; 36-Connecting rod; 37-Swinging rod assembly; 41-Transmission shaft; 42-Gear transmission assembly; 43-Transmission assembly; 44-Banknote pushing member; 81-First side plate; 82-Second side plate; 100-Banknote feeding mechanism; 200-Authentication mechanism; 300-Conveyance mechanism; 400-Banknote temporary storage mechanism; 500-Shielding door; 600-Cash box; 111-Guiding groove; 201-Image detecting mechanism; 202-Magnetism detecting mechanism; 301-Roller set; 302-Impeller; 361-Pivot; 371-First swinging rod; 372-Second swinging rod; 373-Movable rod; 421-Guiding gear; 422-Second gear; 423-Third gear; 430-Supporting shaft; 431-First pulley; 432-Second pulley; 433-Transmission belt; 441-Banknote pushing surface; A-Banknote inlet; B-Banknote outlet; P-Banknote conveyance channel.

DETAILED DESCRIPTION

The present disclosure will be described in combination with the accompanying drawings.

In the description of the present disclosure, it is to be noted that orientational or positional relationships indicated by terms such as 'center', 'up', 'down', 'left', 'right', 'vertical', 'horizontal', 'internal', "external" and so on are orientational or positional relationships based on drawings, which are merely intended for convenience of describing the present disclosure and simplifying description without indicating or suggesting that the specified devices or elements must assume the specific orientations or be constructed and operated at the specific orientations. Furthermore, terms 'first' and 'second' are merely used for descriptive purposes and shouldn't be construed to suggest or indicate relative importance. For example, terms 'first position' and 'second position' refer to two different positions.

Unless otherwise expressly specified and defined, terms 'mount', 'connect' and any other variants thereof should be understood in a broad sense. For example, a 'connection' may be fixed connection, a detachable connection or an integral connection; it may also be a mechanical connection or an electric connection; and it may also be a direct connection or an indirect connection via an intermediate medium.

Figure 2:
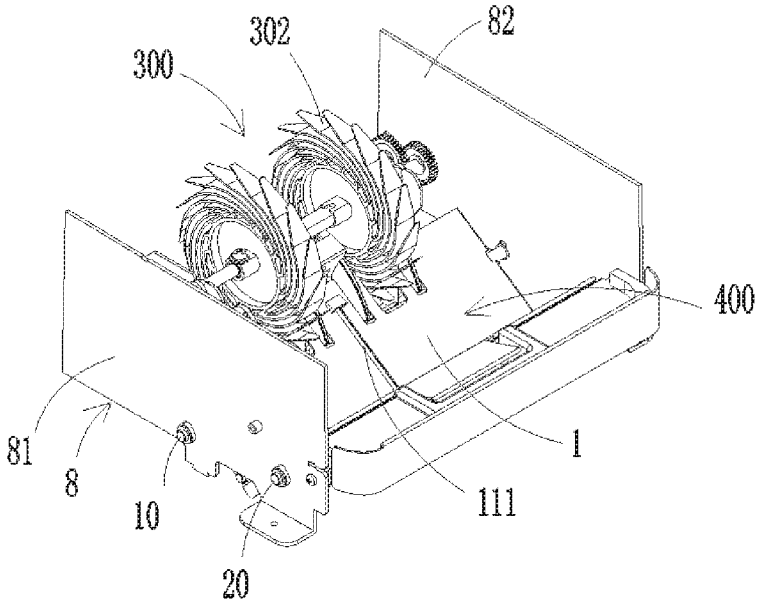
FIG. 2 is a structural schematic view of a banknote processing device according to one embodiment.

FIG. 2 is a structural schematic view of a banknote processing device according to an embodiment.

As illustrated in FIG. 2, the banknote processing device provided by the present embodiment includes a frame 8, a conveyance mechanism 300, a banknote temporary storage mechanism 400, and a cash box (not shown in the figure). The frame 8 includes a first side plate 81 and a second side plate 82 which are oppositely and parallelly arranged and are spaced apart. A banknote conveying channel is formed between the first side plate 81 and the second side plate 82. A distance between the side plate 81 and the second plate 82 is a width of the banknote conveying channel. The conveyance mechanism 300 is configured to drive the banknote to move along a length of the banknote conveyance channel. In this embodiment, the conveyance mechanism 300 includes an impeller 302 arranged at an entrance of the banknote temporary storage mechanism 400. The impeller 302 is configured to rotate to send the banknote, one by one, to the banknote temporary storage mechanism 400. The cash box is arranged under the banknote temporary storage mechanism 400. An inlet is arranged on an upper portion of the cash box.

Figure 3:
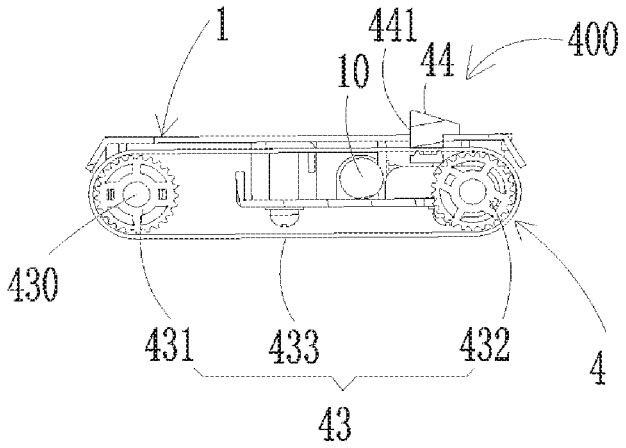
FIG. 3 is a structural sectional view of a banknote temporary storage mechanism according to one embodiment.

FIG. 3 is a structural sectional view of a banknote temporary storage mechanism according to an embodiment.

As illustrated in FIG. 3, the banknote temporary storage mechanism 400 provided by this embodiment includes a first door 1, a driving mechanism (not shown in the figure), and a banknote pushing mechanism 4. Along the direction in which the banknote is conveyed, the first door 1 is downstream of the impeller 302 and above the inlet of the cash box. The blocking door 1 is pivotally connected to the frame 8 through a first shaft 10, and rotatable about an axis of the first shaft 10. The first door 1 has an open position and a closed position.

When the first door 1 is at the closed position, the first door 1 is operative to close the inlet of the cash box, and the banknotes output by the impeller 302 would be stacked on the first door 1. When the first door 1 is at the open position, the inlet of the cash box would be opened, and so the banknotes stacked on the first door 1 would fall into the cash box. The first door 1 is provided with a guiding groove 111. A length of the guiding groove 111 extends along a sliding direction in which the banknote is disengaged from the first door 1. The driving mechanism is in a transmission connection with the first door 1, and is configured to drive the first door 1 to rotate between the open position and the closed position. The banknote pushing mechanism 4 includes a banknote pushing member 44 movably connected to the first door 1. The banknote pushing member 44 partially protrudes from a banknote support surface of the first door 1. When the first door 1 rotates to be opened, the banknote pushing member 44 moves relative to the first door 1 along the guiding groove 111 of the first door 1, and drives the banknote to be disengaged from the banknote support surface of the first door 1.

Optionally, the banknote pushing mechanism 4 includes a banknote-push driving member, a transmission assembly 43, and the banknote pushing member 44. In the present embodiment, the banknote-push driving member includes a motor fixedly mounted to the first door 1. The transmission assembly 43 is mounted on a back side of the first door 1, which is on the back of the banknote support surface of the first door 1. The transmission assembly 43 is connected between the motor and the banknote pushing member 44, and is configured to transmit a torque output by the motor to the banknote pushing member 44 to enable the banknote pushing member 44 to move relative to the first door 1.

The transmission assembly 43 includes a first pulley 431, a second pulley 432 and a transmission belt 433. The first pulley 431 is fixed to a supporting shaft 430. The supporting shaft 430 is mounted on the back side of the first door 1, and is in a transmission connection with the motor. Driven by the motor, the supporting shaft 430 is operative to rotate and thus drive the first pulley 431 to rotate about an axis of the supporting shaft 430. The first pulley 431 and the second pulley 432 are arranged along the sliding direction in which the banknote is disengaged from the first door 1 and are spaced apart from each other. The transmission belt 433 is sleeved on the first pulley 431 and the second pulley 432. When the supporting shaft 430 rotates, the first pulley 431 rotates along with the supporting shaft 430, and drives the transmission belt 433 to move along the sliding direction in which the banknote is disengaged from the first door 1.

A first end of the banknote pushing member 44 is fixedly connected to the transmission belt 433, and a second end of the banknote pushing member 44 penetrates through the guiding groove 111 of the first door 1 to protrude from the banknote support surface of the first door 1 by a set distance. The second end of the banknote pushing member 44 that protrudes from the first door 1 is provided with a banknote pushing surface 441. Optionally, the banknote pushing surface 441 is arranged perpendicular to the banknote support surface of the first door 1. Driven by the transmission belt 433, the banknote pushing member 44 is operative to move along the length of the guiding groove 111, namely, move along the sliding direction in which the banknote is disengaged from the first door 1, so that the banknote pushing surface 441 has an initial position and an end position.

When the banknote pushing surface 411 is at the initial position, the banknote pushing surface 441 is spaced apart from a lower edge of the banknote support surface of the first door 1 by a first set distance. The first set distance matches a total thickness of a maximum number of banknotes received by the banknote temporary storage mechanism at one time. The lower edge of the banknote support surface of the first door 1 refers to a side edge of the banknote support surface that faces away from a rotating axis of the first door 1. When the banknote pushing surface 441 is at the end position, the banknote pushing surface 441 is spaced apart from the lower edge of the banknote support surface of the first door 1 by a second set distance. Optionally, the second set distance is equal to zero, at which point the banknote pushing member 44 fixedly connected to the transmission belt 433 may move to the lower edge of the first door 1, and the banknote pushing surface 441 is flush with the lower edge of the first door 1, so that when the banknote pushing surface 441 pushes the banknote, the banknote can be completely disengaged from the first door 1.

The following is a description of the working process of the banknote temporary storage mechanism provided by the present embodiment.

In a standby state, the first door 1 is at the closed position, and the 44 banknote pushing surface 441 is at the initial position. When entering into the banknote temporary storage mechanism 400, banknotes are stacked on the banknote support surface of the first door 1. If the banknotes are not taken away or it is confirmed to store the banknotes after a set time, namely it is needed to store the banknotes into the cash box 600, the driving mechanism drives the first door 1 to rotate to be opened so that the banknotes fall into the cash box for storage. At the same time, the motor of the banknote pushing mechanism 4 drives the banknote pushing member 44 through the transmission assembly 43 to move thereby moving the banknote pushing surface 441 towards the end position from the initial position and pushing the banknotes to be disengaged from the first door 1, so that the banknotes fall into the cash box. Then the driving mechanism drives the first door 1 to rotate to be closed, and the motor of the banknote pushing mechanism 4 drives through the transmission assembly 43 the banknote pushing member 44 to move thereby moving the banknote pushing surface 441 towards the initial position from the end position and reset.

The banknote temporary storage mechanism provided by the present embodiment includes the first door, the driving mechanism configured to drive the first door to rotate to be opened or closed, and the banknote pushing mechanism. The banknote pushing mechanism includes the banknote-push driving member, the banknote pushing member that protrudes from the banknote support surface of the first door, and the transmission assembly connected between the banknote-push driving member and the banknote pushing member. When the first door rotates to be opened, the banknote-push driving member drives through the transmission assembly the banknote pushing member to move along the sliding direction in which the banknote is disengaged from the first door, and drive the banknote to be totally disengaged from the first door.

Compared with the banknote temporary storage mechanism in the related art, the banknote temporary storage mechanism provided by the present embodiment drives a falling banknote to move through the banknote pushing member, which increases the driving force for disengaging the banknote being from the first door. Thus, the banknote can be prevented from getting jammed, and the banknote can be smoothly disengaged from the first door until the banknote falls into the cash box disposed under the banknote temporary storage mechanism.

Figure 4:
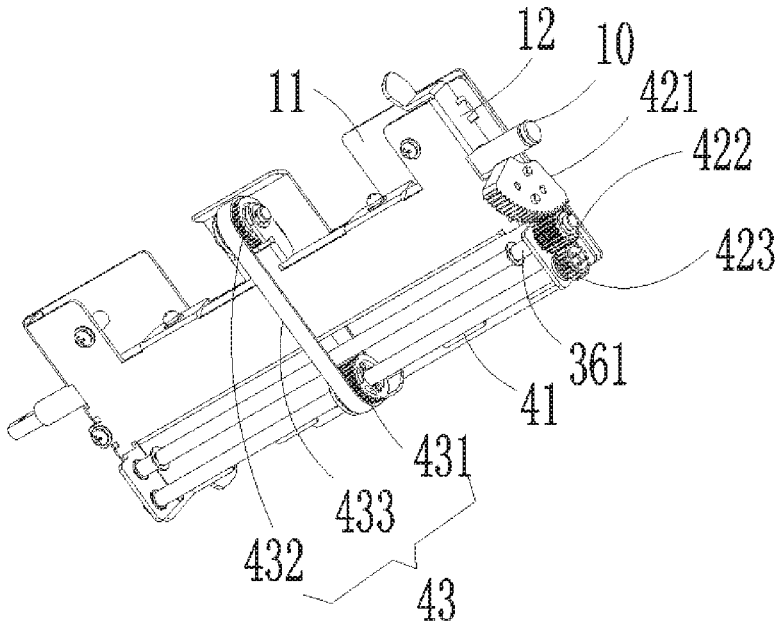
FIG. 4 is a first view of a structure of a banknote temporary storage mechanism according to one embodiment.
Figure 5:
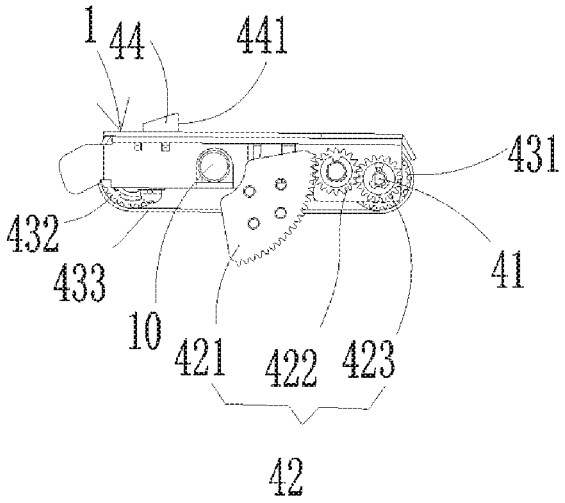
FIG. 5 is a second view of a structure of a banknote temporary storage mechanism according to one embodiment.

FIG. 4 is a first view of a structure of a banknote temporary storage mechanism according to one embodiment. FIG. 5 is a second view of a structure of a banknote temporary storage mechanism according to one embodiment.

As illustrated in FIG. 4 and FIG. 5, differing from the first embodiment, the banknote-push driving member in this embodiment is in a transmission connection to the first door 1. When the first door 1 rotates between the open position and the closed position, the first door 1 drives the banknote-push driving member to move, so that the banknote-push driving member drives the transmission assembly 43 to drive the banknote pushing member 44 to move relative to the first door 1. The banknote-push driving member includes a transmission shaft 41 and a gear transmission assembly 42.

In the present embodiment, the first door 1 includes a first supporting plate 11 and two side walls 12. The first supporting plate 11 is configured to be an end surface for supporting the banknote. The two side walls 12 are located at two sides of the first supporting plate 11 along a width of the banknote conveyance channel, and perpendicularly connected to the first supporting plate 11. The first shaft 10 is fixedly connected to the first supporting plate 11. Two ends of the first shaft 10 penetrate through the two side walls 12 of the first door 1, and then fitly inserted to a first side plate 81 and a second side plate 82 of the frame 8, respectively. The first shaft 10 is rotatable, relative to the frame 8, about the axis of the first shaft 10, and drives the first door 1, fixedly connected to the first shaft 10, to rotate between the open position and the closed position.

The transmission shaft 41 of the banknote-push driving member is rotatably arranged on the back side of the first supporting plate 11. Two ends of the transmission shaft 41 are supported by the two side walls 12. An axis of the transmission shaft 41 extends along the width of the banknote conveyance channel, and the transmission shaft 41 is freely rotatable about the axis thereof. When the first door 1 rotates about the axis of the first shaft 10 to be opened or closed, the transmission shaft 41 rotates about the axis of the first shaft 10 with the first shaft 10. The gear transmission assembly 42 is connected between the transmission shaft 41 and the first door 1, and is configured to transmit the rotational torque of the first door 1 to the transmission shaft 41 as the first door 1 rotates to be opened or closed, so as to rotate the transmission shaft 41 along therewith.

The gear transmission assembly 42 includes a guiding gear 421 and a transmission gear. The transmission gear 421 may refer to a first gear. The transmission gear includes a second gear 422 and a third gear 423. The guiding gear 421 is fixedly mounted on the frame 8. The guiding gear 421 and the first shaft 10 are coaxially arranged. Optionally, the guiding gear 421 is a sector gear centered on the axis of the first shaft 10, a central angle of the sector gear is greater than or equal to a maximum opening angle of the first door 1, which improves the space utilization. The second gear 422 is sleeved on a gear shaft. The gear shaft is perpendicularly arranged on the side wall 12 of the first door 1. The second gear 12 is freely rotatable about an axis of the gear shaft.

When the first door 1 rotates about the axis of the first shaft 10, the second gear 422 rotates, along with the first door 1, about the axis of the first shaft 10. The second gear 422 is in a meshing connection with the guiding gear 421. During the rotation process of the first door 1, since the guiding gear 421 is fixed and the second gear 422 revolves around the axis of the first shaft 10, the second gear 422 rolls along the guiding gear 421, namely, during the rotation process of the first door 1, the second gear 422 revolves around the axis of the first shaft 10 and revolves on the axis of the gear shaft. The third gear 423 is fixedly sleeved on an end of the transmission shaft 41, and is in a meshing connection with the second gear 422. When the second gear 422 rotates, the second gear 422 drives the third gear 423 and the transmission shaft 41 to rotate about the axis of the transmission shaft 41.

The transmission assembly 43 is connected between the transmission shaft 41 and the banknote pushing member 44, and is configured to transmit the rotational torque of the transmission shaft 41 to the banknote pushing member 44, so that the banknote pushing member 44 moves along the sliding direction in which the banknote is disengaged from the first door 1. The first pulley 431 of the transmission assembly 43 is fixedly sleeved on the transmission shaft 41. When the transmission shaft 41 rotates about the axis of the transmission shaft 41, the first pulley 431 rotates with the transmission shaft 41, so that the banknote pushing member 44 is driven, through the transmission belt 433, to move along the sliding direction in which the banknote is disengaged from the first door 1.

In other embodiments, there may be one or at least three transmission gears. When there is one transmission gear, the transmission gear is directly and is in a transmission connection to the transmission assembly 43. When there are at least three transmission gears, the guiding gear 421 is meshed with the at least three transmission gears in sequence. The transmission gear farthest from the guiding gear 421 is in a transmission connection with the transmission assembly 43.

The following is a description of the working process of the banknote temporary storage mechanism provided by this embodiment.

In the standby status, the first door 1 is at the closed position, the banknote pushing member 44 is at the initial position. When entering into the banknote temporary storage mechanism, the banknotes are stacked on the first door 1. If the banknotes are not taken away after the set time or it is confirmed to store the banknotes, the driving mechanism drives the first door 1 to rotate to be opened, so that the banknotes stacked on the first door 1 fall in to the cash box for storage. At the same time, the first door 1 rotates and drives the second gear 422 to roll along the guiding gear 421, so that the second gear 422 rotates about the axis of the second gear 422. The rotation of the second gear 422 drives the third gear 423, in meshing connection with the second gear 422, and the transmission shaft 41 to rotate. The transmission shaft 41 drives, through the first pulley 431 and the transmission belt 433, the banknote pushing member 44 to move towards the end position from the initial position, so that the banknote which is not disengaged from the first door 1 is pushed into the cash box. Then the driving mechanism drives the first door 1 to rotate to be closed. The first door 1 reversely rotates and drives the second gear 422 to reversely roll along the guiding gear 421, so that the second gear 422 reversely rotates about the axis of the second gear 422. The reverse rotation of the second gear 422 drives the third gear 423 and the transmission shaft 41 to reversely rotate. The transmission shaft 41 drives, through the first pulley 431 and the transmission belt 433, the banknote pushing member 44 to move towards the initial position from the end position and then reset.

The banknote-push driving member of the banknote temporary storage mechanism provided by the present embodiment includes the transmission shaft and the gear transmission assembly. The transmission shaft is rotatably arranged on the back side of the first door. The gear transmission assembly is connected between the transmission shaft and the first door. The transmission assembly is connected between the transmission shaft and the banknote pushing member. When the first door rotates to be opened, the gear transmission assembly transmits the rotational torque of the first door to the transmission shaft to rotate it, the transmission assembly transmits the rotational torque of the transmission shaft to the banknote pushing member so that the banknote pushing member moves along the sliding direction in which the banknote is disengaged from the first door, the banknote pushing member pushes, during moving, the banknote to be disengaged from the first door. The first door of the present embodiment rotates and drives the banknote pushing member to move, which is no need to separately configure the motor to drive the banknote pushing member, thus resulting in a simple structure and low cost.

Figure 6:
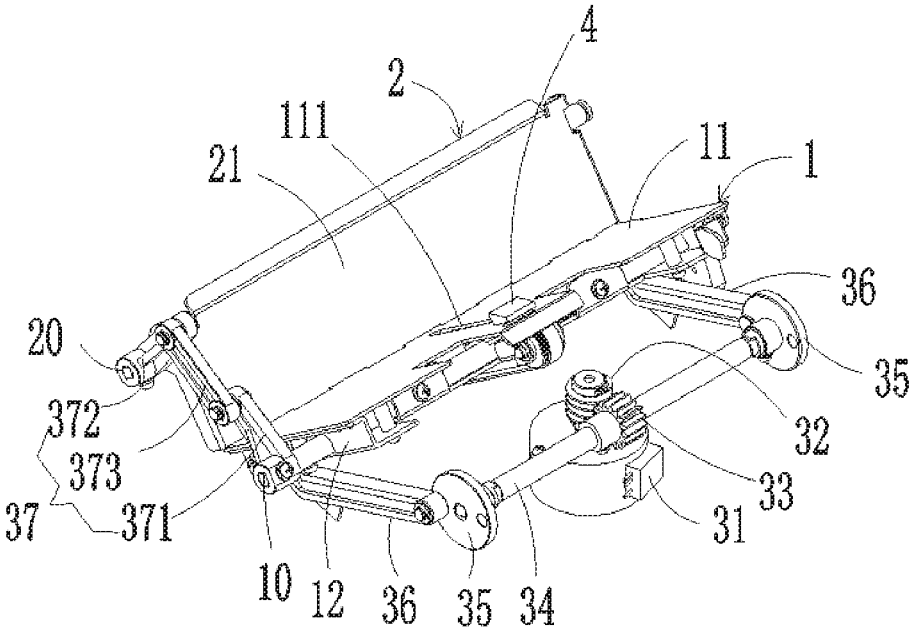
FIG. 6 is a structural schematic view of a banknote temporary storage mechanism according to one embodiment.

FIG. 6 is a structural schematic view of a banknote temporary storage mechanism according to one embodiment.

As illustrated in FIG. 6, in the present embodiment, the banknote temporary storage mechanism further includes a second door 2. Along a direction in which the banknote enters into the banknote temporary storage mechanism, the second door 2 is arrange downstream of the first door 1.

A second shaft 20 is fixedly arranged on a back side of the second door 2. The axes of the first shaft 10 and the second shaft 20 both extend along the width of the banknote conveyance channel. Two ends of the first shaft 10 and the second shaft 20 are supported by the first side plate 81 and the second side plate 82. Driven by the driving mechanism, the first door 1 and the second door 2 are configured to synchronously and reversely rotate about the respective axis of the shaft, respectively, and can be in the open position and the closed position at the same time. When the first door 1 and the second door 2 are in the closed position at the same time, the first door 1 and the second door 2 join together at an angle, and jointly closes the inlet of the cash box, forming a banknote stacking space, the banknotes entering into the banknote temporary storage mechanism are stacked on the first door 1 and the second door 2. When the first door 1 and the second door 2 are in the open position at the same time, the inlet of the cash box is opened, the banknotes stacked on the first door 1 and the second door 2 fall into the cash box.

The second door 2 includes a second supporting plate 21 and two side walls (not shown in the drawing). The second supporting plate 21 is configured to support a surface of the banknote. The two side walls are located at two sides of the second supporting plate 21 along the width of the banknote conveyance channel, and both perpendicularly connected to the second supporting plate 21. The second shaft 20 is fixedly connected to the second supporting plate 21. Two ends of the second shaft 20 penetrates through the two side walls of the second door 2, and then are fitly inserted into the first side plate 81 and the second side plate 82. The second shaft 20 is configured to rotate, relative to the frame 8, about an axis of the second shaft 20, and drive the second door 2, fixed connected to the second shaft 20, to rotate between the closed position and the open position.

When the first door 1 and the second door 2 are in the closed position at the same time, the first supporting plate 11 and the second supporting plate 21 join together. An obtuse angle is formed between the first supporting plate 11 and the second supporting plate 21. When the banknote falls on the first door 1 and the second door 2, an end surface of the banknote abuts against the first supporting plate 11, a surface of the banknote is in contact with the second supporting plate 21. When the first door 1 and the second door 2 are in the open position at the same time, the inlet of the cash box is totally opened, the banknote stacked on the first door 1 and the second door 2 falls into the cash box.

The driving mechanism is configured to drive the first door land the second door 2 to rotate between the open position and the closed position. The driving mechanism includes a motor 31, a cam 35, a connecting rod 36 and a swinging rod assembly 37. The motor 31 is fixedly arranged on the frame 8. The cam 35 is in a transmission connection with the motor 31, and configured to rotate, driven by the motor 31, about an axis of the cam 35. A first end of the connecting rod 36 is pivotally connected to cam 35, and a second end of the connecting rod 36 is pivotally connected to the side wall 12 of the first door 1 through a pivot 361 (As shown in FIG. 4). When the cam 35 rotates, the connecting rod 36 drives the first door 1 to rotate about the axis of the first shaft 10. The swinging rod assembly 37 is connected between the first shaft 10 and the second shaft 20. When the first door 1 rotates, the swinging rod assembly 37 drives the second door 2 to synchronously and reversely rotate, relative to the first door 1, about the axis of the second shaft 20, so that the first door 1 and the second door 2 are in the open position or the closed position at the same time.

In the present embodiment, the cam 35 is in a transmission connection to the motor 31 through a driving assembly. The driving assembly includes a worm 32, a worm gear 33 and a driving shaft 34. An axis of the driving shaft 34 is parallel to the axis of the first shaft 10, two ends of the driving shaft 34 are supported by the frame 8, and the driving shaft 34 is configured to freely rotate about an axis thereof. The worm 32 is coaxially and fixedly connected to an output shaft of the motor 31. The worm gear 33 is fixedly sleeved on the driving shaft 34. The worm gear 33 is in meshing connection with the worm 32. When the output shaft of the motor 31 rotates, the driving shaft 34 is driven to rotate about the axis of the driving shaft 34 through the transmission of the worm gear and the worm. The cam 35 is fixedly mounted on an end of the driving shaft 34. When the driving shaft 34 rotates about the axis of the driving shaft 34, the cam 35 rotates about the axis of the driving shaft 34 along with the driving shaft 34. In other embodiments, the cam 35 may be directly and fixedly mounted on the output shaft of the motor 31, or the cam 35 and the motor 31 is in a transmission connection with each other through a gear assembly.

The swinging assembly 37 includes a first swinging rod 371, a second swinging rod 372 and a movable rod 373. A first end of the first swinging rod 371 is fixedly connected to the first shaft 10. When the first shaft 10 rotates about the axis of the first shaft 10, the first swinging rod 371 rotates about the axis of the first shaft 10 along with the first shaft 10. A first end of the second swinging rod 372 is fixedly connected to the second shaft 20. When the second shaft 20 rotates about the axis of the second shaft 20, the second swinging rod 372 rotates about the axis of the second shaft 20 along with the second shaft 20. A first end of the movable rod 373 is pivotally connected to a second end of the first swinging rod 371. The movable rod 373 and the first swinging rod 371 are relatively rotatable about a pivot axis of the movable rod 373 and the first swinging rod 371. A second end of the movable rod 373 is pivotally connected to a second end of the second swinging rod 372. The movable rod 373 and the second swinging rod 372 are relatively rotatable about a pivot axis of the movable rod 373 and the second swinging rod 372. When one of the first swinging rod 371 and the second swinging rod 372 rotates about the respective axis of the shaft, the movable 373 drives another of the first swinging rod 371 and the second swinging rod 372 to rotate about the respective axis of the shaft.

When the motor 31 drives, through the cam 35 and the connecting rod 36, the first door 1 to rotate, since the first shaft 10 is fixedly connected to the first door 1, the first door 1 drives the first shaft 10 to rotate about the axis of the first shaft 10, the first shaft 10 drives the first swinging rod 371, fixedly connected to the first shaft 10, to rotate about the axis of the first shaft 10. The first swinging rod 371 drives, through the movable rod 373, the second swinging rod 372 to rotate about the axis of the second shaft 20. Since the second swinging rod 372 is fixedly connected to the second shaft 20, the second shaft 20 rotates, along with the second swinging rod 372, about the axis of the second shaft 20, the second rotating rod 20 drives the second door 2 to rotate, so that the second door 2 and the first door 1 are operative synchronously and reversely rotate.

In one embodiment, the banknote temporary storage mechanism includes two banknote pushing mechanisms 4 respectively arranged on the first door 1 and the second door 2. The structure and working principle of the banknote pushing mechanism 4 arranged on the second door 2 are the same as those described in the above embodiments.

The banknote temporary storage mechanism provided by the present embodiment further includes the second door. When the first door and the second door are closed, the end surface of the banknote abuts against the first supporting plate of the first door, and the surface of the banknote is in contact with the second supporting plate of the second door. As the banknotes are ejected by the impeller one by one, the banknotes are stacked on the second door. Since an obtuse angle is formed between the first supporting plate and the second supporting plate, the banknotes can be neatly stacked on the first door and the second door, and at the same time, the banknotes are stacked at an angle to the horizontal plane, which is also convenient for the user to pick up.

Figure 7:
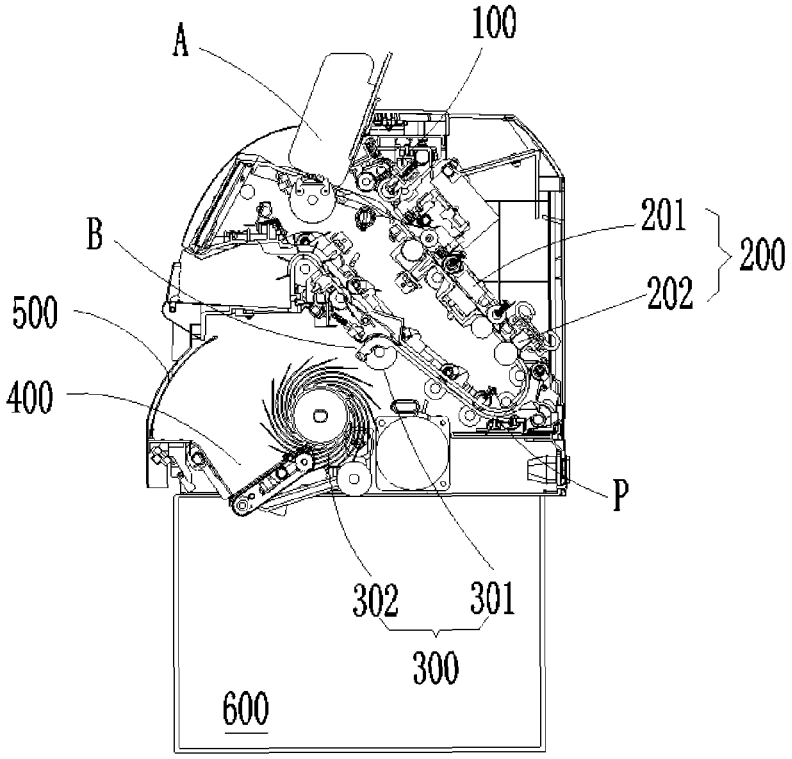
FIG. 7 is a structural schematic view of a banknote processing device according to another embodiment.

FIG. 7 is a structural schematic view of a banknote processing device according to another embodiment. As illustrated in FIG. 7, the banknote processing device includes a banknote feeding mechanism 100, an authentication mechanism 200, a conveyance mechanism 300, a banknote temporary storage mechanism 400, a shielding door 500, and a cash box 600. The banknote feeding mechanism 100 is arranged at a banknote inlet A of the banknote processing device. The shielding door 500 and the banknote temporary storage mechanism 400 are arranged at a banknote outlet B of the banknote processing device. When the shielding door 500 closes the banknote outlet B, the banknote temporary storage mechanism 400 is enclosed to an inside of the banknote processing device. A banknote conveyance channel P is connected between the banknote inlet A and the banknote outlet B. The authentication mechanism 200 and the conveyance mechanism 300 are arranged on the banknote conveyance channel P.

The banknote feeding mechanism 100 is configured to send the banknotes stacked at the banknote inlet A to the authentication mechanism 200 one by one. The authentication mechanism 200 includes an image detecting mechanism 201 and a magnetism detecting mechanism 202. The image detecting mechanism 201 includes two image sensors oppositely arranged, and is configured to acquire image information of front and back sides of the banknote. The magnetism detecting mechanism 202 is configured to detect magnetic feature separately arranged on the banknote. The conveyance mechanism 300 is configured to drive the banknote to move along the banknote conveyance channel P. In the present embodiment, the conveyance mechanism 300 includes a plurality of roller sets 301 arranged in sequence between the authentication mechanism 200 and the banknote outlet B, and an impeller 302 arranged between the banknote outlet B and the banknote temporary storage mechanism 400.

The banknote temporary storage mechanism 400 is configured to temporarily store the banknote which has been authenticated as real banknote. The structure and working principle of the banknote temporary storage mechanism 400 are the same as those described in the above embodiments.

When the banknote processing device is working, the shielding door 500 shields the banknote outlet B, and the first door 1 of the banknote temporary storage mechanism 400 is at the closed position. The banknote enters into the banknote conveyance channel P through the banknote inlet A, and moves, driven by the conveyance mechanism 300, along the banknote conveyance channel P. The banknote passes through the authentication mechanism 200, is authenticated by the authentication mechanism 200, and then sent, by the impeller 302, to the first door 1 of the banknote temporary storage mechanism 400 to be stacked. After the entire banknote processing is completed, the shielding door 500 is opened, waiting for the user to take away the banknote stacked on the first door 1. If the banknote is not taken away after a set time, the driving mechanism of the banknote temporary storage mechanism 400 drives the first door 1 to rotate towards the open position, at the same time the banknote pushing member 44 of the banknote pushing mechanism 4 pushes the banknote, so that all banknotes on the first door 1 fall into the cash box to be stored.

The banknote processing device of the present embodiment adopts the banknote temporary storage mechanism provided by the present embodiment, so that all banknotes fall in to the cash box during the banknote recycle, and the problem of banknote jamming is avoided.

INDUSTRIAL APPLICABILITY

The banknote temporary storage mechanism and the banknote processing device provided by the present disclosure pushes the banknote to move through the banknote pushing member as the banknote is falling, thereby increasing the driving force for disengaging the banknote from the first door, thus preventing the banknote from jamming, so that the banknote can be smoothly disengaged from the first door until the banknote falls into the cash box disposed under the banknote temporary storage mechanism.

The invention claimed is:

1. A banknote temporary storage mechanism, comprising:

A frame;

A first door pivotally connected to the frame; and

A banknote pushing mechanism;

Wherein the first door has an open position and a closed position;

Wherein the banknote pushing mechanism comprising a banknote pushing member, which is movable connected to the first door and protrudes from a banknote support surface of the first door; and Wherein the banknote pushing member is configured to, as the first door rotates towards the open position from the closed position, move relative to the first door along a direction in which a banknote is disengaged from the first door, to push the banknote to be disengaged from the first door.

2. The banknote temporary storage mechanism according to claim 1, further comprising:

a banknote-push driving member; and a transmission assembly connected between the banknote-push driving member and the banknote pushing member;

wherein the banknote-push driving member is configured to drive the transmission assembly to move, and during movement of the transmission assembly the transmission assembly is operative to drive the banknote pushing member to move relative to the first door.

3. The banknote temporary storage mechanism according to claim 2, wherein the transmission assembly comprises a first pulley and a second pulley that are arranged along the direction in which the banknote is disengaged from the first door and that are spaced apart from each other, the transmission assembly further comprising a transmission belt connected between the first pulley and the second pulley, wherein the banknote pushing member is connected to the transmission belt, and the banknote-push driving member is in a transmission connection with the first pulley.

4. The banknote temporary storage mechanism according to claim 2, wherein the banknote-push driving member is in a transmission connection to the first door the first door is configured to, as the first door rotates between the open position and the closed position, drive the banknote-push driving member to move, to make the banknote-push driving member drive the transmission assembly to move, and during the movement of the transmission assembly the transmission assembly is operative to drive the banknote pushing member to move relative to the first door.

5. The banknote temporary storage mechanism according to claim 4, wherein the banknote-push driving member comprises a guiding gear fixedly connected to the frame, and a transmission gear pivotally connected to the first door;

wherein a central axis of the guiding gear coincides with a rotating axis of the first door;

wherein the guiding gear is meshed with the transmission gear; and wherein the transmission gear is in a transmission connection with the transmission assembly.

6. The banknote temporary storage mechanism according to claim 5, wherein the guiding gear is a sector gear.

7. The banknote temporary storage mechanism according to claim 1, wherein the banknote pushing member has an initial position and an end position;

wherein, when the banknote pushing member is at the initial position, a distance between the banknote pushing member and a side edge of the banknote support surface away from a rotating axis of the first door matches a total thickness of a maximum number of banknotes the first door receives at one time;

wherein, when the banknote pushing member is at the end position, the banknote pushing member is operative to push the banknote to be disengaged from the banknote support surface.

8. The banknote temporary storage mechanism according to claim 1, wherein the banknote pushing member has a banknote pushing surface arranged perpendicular to the banknote support surface.

9. The banknote temporary storage mechanism according to claim 1, wherein the first door is provided with a guiding groove extending along the direction in which the banknote is disengaged from the first door, and the banknote pushing member is inserted into the guiding groove and is configured to move along a length of the guiding groove.

10. The banknote temporary storage mechanism according to claim 1, further comprising:

a second door pivotally connected to the frame, the second door having an open position and a closed position;

wherein, when the first door and the second door are both in the closed position, the first door and the second door join together at an angle to form a banknote stacking space;

wherein, when the first door and the second door are both in the open position, the first door and the second door are separated from each other.

11. A banknote processing device, comprising:

A banknote temporary storage mechanism, the banknote temporary storage mechanism comprising a frame, a first door pivotally connected to the frame, and a banknote pushing mechanism;

Wherein the first door has an open position and a closed position;

Wherein the banknote pushing mechanism comprising a banknote pushing member, which is movable connected to the first door and protrudes from a banknote support surface of the first door; and Wherein the banknote pushing member is configured to, as the first door rotates towards the open position from the closed position, move relative to the first door along a direction in which a banknote is disengaged from the first door, to push the banknote to be disengaged from the first door.

12. The banknote processing device according to claim 11, wherein the banknote temporary storage mechanism further comprises a banknote-push driving member, and a transmission assembly connected between the banknote-push driving member and the banknote pushing member, wherein the banknote-push driving member is configured to drive the transmission assembly to move, and during movement of the transmission assembly the transmission assembly is operative to drive the banknote pushing member to move relative to the first door.

13. The banknote processing device according to claim 12, wherein the transmission assembly comprises a first pulley and a second pulley that are arranged along the direction in which the banknote is disengaged from the first door and that are spaced apart from each other, the transmission assembly further comprising a transmission belt connected between the first pulley and the second pulley, wherein the banknote pushing member is connected to the transmission belt, and the banknote-push driving member is in a transmission connection with the first pulley.

14. The banknote processing device according to claim 12, wherein the banknote-push driving member is in a transmission connection to the first door, wherein the first door is configured to, as the first door rotates between the open position and the closed position, drive the banknote-push driving member to move, to make the banknote-push driving member drive the transmission assembly to move, and during the movement of the transmission assembly the transmission assembly is operative to drive the banknote pushing member to move relative to the first door.

15. The banknote processing device according to claim 14, wherein the banknote-push driving member comprises a guiding gear fixedly connected to the frame, and a transmission gear pivotally connected to the first door, wherein a central axis of the guiding gear coincides with a rotating axis of the first door, wherein the guiding gear is meshed with the transmission gear, and wherein the transmission gear is in a transmission connection with the transmission assembly.

16. The banknote processing device according to claim 15, wherein the guiding gear is a sector gear.

17. The banknote processing device according to claim 11, wherein the banknote pushing member has an initial position and an end position;

wherein, when the banknote pushing member is at the initial position, a distance between the banknote pushing member and a side edge of the banknote support surface away from a rotating axis of the first door matches a total thickness of a maximum number of banknotes the first door receives at one time;

wherein, when the banknote pushing member is at the end position, the banknote pushing member is operative to push the banknote to be disengaged from the banknote support surface.

18. The banknote processing device according to claim 11, wherein the banknote pushing member has a banknote pushing surface arranged perpendicular to the banknote support surface.

19. The banknote processing device according to claim 11, wherein the first door is provided with a guiding groove extending along the direction in which the banknote is disengaged from the first door, and the banknote pushing member is inserted into the guiding groove and is configured to move along a length of the guiding groove.

20. The banknote processing device according to claim 11, wherein the banknote temporary storage mechanism further comprises a second door pivotally connected to the frame, the second door having an open position and a closed position;

wherein, when the first door and the second door are both in the closed position, the first door and the second door join together at an angle to form a banknote stacking space;

wherein, when the first door and the second door are both in the open position, the first door and the second door are separated from each other.

* * * * *